United States Patent [19]

Theurer et al.

[11] Patent Number: 4,744,302

[45] Date of Patent: May 17, 1988

[54] MECHANISM FOR BENDING ABUTTING RAIL SECTION ENDS AT RAIL JOINTS IN THE OPERATION OF A TRACK WORKING MACHINE

[75] Inventors: Josef Theurer, Vienna; Friedrich Peitl, Linz, both of Austria

[73] Assignee: Franz Plasser Bahnbaumaschinen-Industriegesellschaft, Vienna, Austria

[21] Appl. No.: 858,108

[22] Filed: May 1, 1986

[30] Foreign Application Priority Data

Jun. 28, 1985 [EP] European Pat. Off. ..... 85890146.5

[51] Int. Cl.[4] ..... E01B 31/08; B21D 7/12

[52] U.S. Cl. ..... 104/7.2; 104/7.1; 254/43; 72/12; 72/389; 72/702

[58] Field of Search ..... 104/2, 7.1, 12, 7.2; 72/12, 389, 702; 254/43

[56] References Cited

U.S. PATENT DOCUMENTS

| | | | |
|---|---|---|---|
| 3,119,346 | 1/1964 | Derler | 104/7.1 X |
| 3,134,339 | 5/1964 | Plasser et al. | 104/7.2 |
| 3,299,833 | 1/1967 | Stewart | 104/7.1 |
| 3,333,445 | 8/1967 | Mergler et al. | 72/702 X |
| 3,430,578 | 3/1969 | Stewart | 104/7.1 |
| 3,461,810 | 8/1969 | Yard | 104/7.1 |
| 3,713,312 | 1/1973 | Galdabini | 72/702 X |
| 3,943,857 | 3/1976 | Theurer | 104/7.1 |
| 4,323,013 | 4/1982 | Theurer | 104/7.2 |

FOREIGN PATENT DOCUMENTS

| | | | |
|---|---|---|---|
| 127935 | 12/1984 | European Pat. Off. . | |
| 1540199 | 2/1979 | United Kingdom . | |
| 0662479 | 5/1979 | U.S.S.R. | 254/43 |

*Primary Examiner*—Johnny D. Cherry
*Assistant Examiner*—Scott H. Werny
*Attorney, Agent, or Firm*—Collard, Roe & Galgano

[57] ABSTRACT

In a mobile track working machine comprising a frame mounted for mobility on the track: a mechanism for bending the track rail section ends comprises a carrier frame vertically adjustably mounted on the machine frame above a respective track rail and having respective end regions spaced from each other in the direction of the track rail, a respective hydraulically operable and vertically adjustable thrust element mounted in a respective end region of the carrier frame for engagement with the running face of the track rail, an intermediate carrier transversely movably mounted on the carrier frame, and a rail lifting hook device supported centrally between the thrust elements on the intermediate carrier for engagement with the track rail, the hook device including two lifting hooks arranged symmetrically with respect to the vertical plane of symmetry of the rail, a respective pivot having an axis extending in the direction of the track rail and mounting a respective lifting hook for pivoting into a rail engaging position wherein the lifting hook subtends the rail head, and a respective drive linked to each lifting hook at another pivot for pivoting the hook linked thereto.

4 Claims, 2 Drawing Sheets

Fig. 3
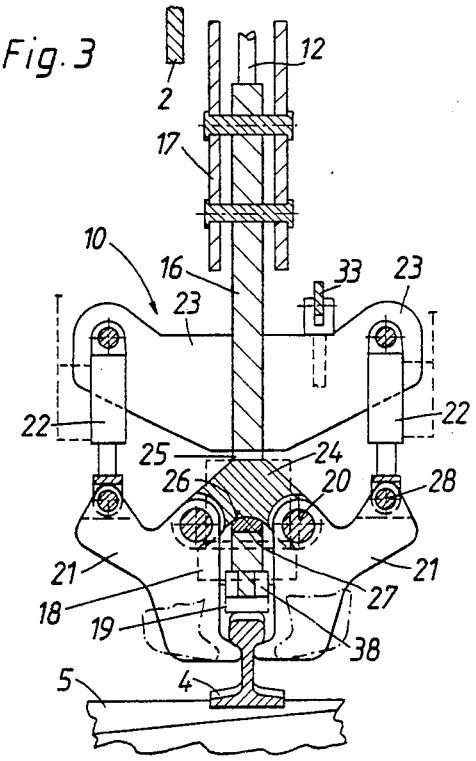
Fig. 6
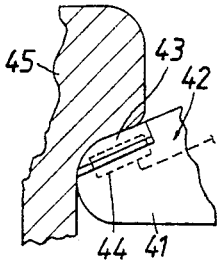
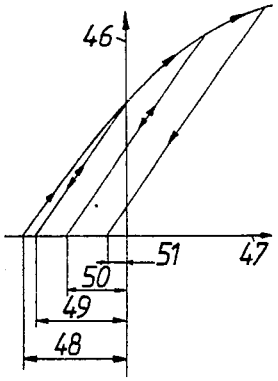
Fig. 5
Fig. 4
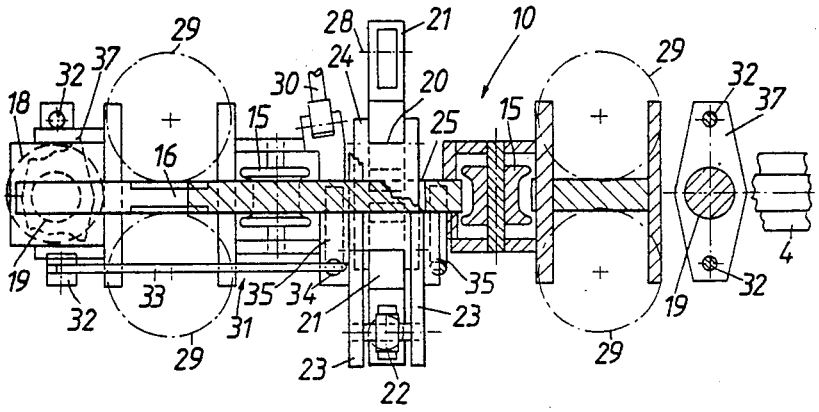

MECHANISM FOR BENDING ABUTTING RAIL SECTION ENDS AT RAIL JOINTS IN THE OPERATION OF A TRACK WORKING MACHINE

The present invention relates to a mobile track working machine for a track consisting of two rails fastened to ties, each rail having a rail head defining a running face and a vertical plane of symmetry and consisting of track rail sections having abutting ends forming rail joints, the track working machine comprising a frame mounted for mobility on the track and a mechanism for bending the track rail section ends. It also relates to a method for bending the track rail section ends with such a bending mechanism in the operation of the track working machine.

U.S. Pat. No. 3,943,857, dated Mar. 16, 1976, discloses a machine of this type. It comprises a carrier frame which has two undercarriages at respective ends thereof for guiding the carrier frame along the track and which is vertically adjustably mounted on the machine frame by vertical adjustment drives. These undercarriages also serve as hydraulically operable and vertically adjustable thrust elements mounted in the end regions of the carrier frame for engagement with the running face of the track rail. A rail lifting hook device is mounted centrally between the thrust elements on the carrier frame for engagement with the track rail for lifting the track rail section ends at the rail joint upon operation of a cylinder-piston drive connected to the rail lifting hook. The upward bending of the track section rail ends by the lifting hook is controlled by a pair of rollers vertically movably mounted at respective sides of the lifting hook on the carrier frame and the rollers can be fixed in an adjusted vertical position by a mechanical stop. The drives for the bending mechanism are controlled to obtain the desired extent of bending by a control arrangement set for the desired extent of bending and cooperating with a scale arranged on the carrier frame and operating as a transducer, the scale having a sensor engaging the rail joint to serve as a reference determining the actual level of the track rail and the extent of the upward bend of the abutting rail section ends at the rail joint. When the lifting hook is raised to bend the track rail section ends upwardly, the rollers resting on the ends are correspondingly lifted with the sensor, generating a signal emitted by the transducer until this signal corresponds to that set in the control arrangement to indicate the desired extent of bending. The entire bending operation preferably proceeds in a single step.

British Pat. No. 1,540,199, published Feb. 7, 1979, also discloses a track working machine with a mechanism for bending the abutting track rail section ends at a rail joint. It comprises a vertically adjustable carrier frame linked to the machine frame and having at its ends downwardly directed thrust elements embodied in hydraulically operable pressure cylinders with rams engaging the running face of the track rail. A rail lifting hook designed to subtend the base of the rail is mounted between the two thrust elements and is pivotal transversely to the direction of the rail for engagement therewith and disengagement therefrom, the lifting hook being arranged in a vertical guide slot of the carrier frame, which enables the hook to be pivoted. The lifting hook is additionally guided in a partially curved guide slot by a bolt and its lower end is connected to the carrier frame by a drive for pivoting the hook. A rail clamping and lifting roller unit is also mounted on the carrier frame so that the machine may be used also for leveling and lining track. In the operation of the mechanism for bending the abutting track rail section ends at rail joints, the lifting hook is pivoted to subtend the base of the rail for engagement therewith while the lifting rollers at both sides of the lifting hook hold the rail in position and the rams of the thrust elements are moved against the running face of the rail under hydraulic pressure. The magnitude of the bending moment effective in the vertical plane defined by the rail is selectively adjustable by the vertical adjustment of the ram. Rail joints which have been depressed considerably by heavy train traffic are preferably bent upwardly above the level of the track. This technology for adjusting the levels of rail joints of existing tracks has been commercially used with great success but the engagement of the lifting hook with the base or foot of the rail has disadvantages since it often requires the removal of ballast to make room for the hook movement and engagement with the rail.

It is the primary object of this invention to overcome this and other disadvantages, and to provide a mobile track working machine with a rail bending mechanism of simple structure and capable of transmitting high bending forces to abutting track rail section ends at rail joint without any problems and in an effective operation.

The above and other objects are accomplished according to the invention with a mechanism for bending the track rail section ends, which comprises a carrier frame vertically adjustably mounted on the machine frame above a respective track rail and having respective end regions spaced from each other in the direction of the track rail, a respective hydraulically operable and vertically adjustable thrust element mounted in a respective end region of the carrier frame for engagement with the running face of the track rail, and a rail lifting hook device mounted centrally between the thrust elements on the carrier frame for engagement with the track rail, the hook device including two lifting hooks arranged symmetrically with respect to the vertical plane of symmetry of the rail, a respective pivot having an axis extending in the direction of the track rail and mounting a respective lifting hook for pivoting into a rail engaging position wherein the lifting hook subtends the rail head, and a respective drive linked to each lifting hook at another pivot for pivoting the hook linked thereto.

In the operation of the mobile track working machine with such a bending mechanism, the present invention provides a method comprising the steps of engaging the thrust elements with the running face of the one track rail to establish a measuring base, determining any deviation from the measuring base at the track rail section ends by obtaining electrical signals from respective displaceable sensors arranged at the rail joint and engaging the track rail section ends, transmitting the electrical signals to a control station, subsequently pivoting the lifting hooks into the rail engaging position to engage the track rail section ends, hydraulically operating the thrust elements to keep them in engagement with the running face of the one track rail while lifting the track rail secton ends stepwise with the engaged lifting hooks while continuously measuring the lifting stroke on the basis of the electrical signals received at the control station until the track rail section ends at the rail joint have been lifted to a selected excess level, the hydraulic operation of the thrust elements being interrupted between each one of the lifting steps and the lifting strokes in successive steps being automatically reduced as the selected excess level is approached in response to the electrical signals obtained when the hydraulic operation is interrupted.

Since the rail head is clamped securely between the two lifting hooks, even very high pressures generated by the downward thrust of the thrust elements are transmitted through the carrier frame as bending forces to the rail so that even rails of large cross section may be bent very accurately to a predetermined extent. The symmetrical arrangement leads to a simple and stable pivotal bearing for the lifting hooks so that the loads of even very high bending forces and jolts imparted to the rail are transmitted evenly and symmetrically to the lifting hooks and the rail fastening elements while the hooks readily engage the rail when pivoted to subtend the rail head. This very stable bearing for the lifting hooks, which can withstand considerable impacts, and the strong engagement between the lifting hooks and the rail, which is reinforced by the pressure exerted by the separate pivoting drives for each hook, is particularly suited for use in a stepwise bending method which enhances the bending accuracy but exposes the lifting hooks to repeated extreme impacts during each successive bending step. At the same time, this simple but robust construction with a pair of lifting hooks symmetrically clamping the rail head therebetween increases the efficiency of the machine.

The above and other objects, advantages and features of this invention will become more apparent from the following detailed description of certain now preferred embodiments thereof, taken in conjunction with the accompanying, partly schematic drawing wherein FIG. 1 is a generally schematic side view of a mobile track working machine incorporating a mechanism for bending the track rail section ends forming a rail joint;

FIG. 3 is a section along line III—III of FIG. 2;

FIG. 4 is a top view of the bending mechanism, partly in section along line IV—IV of FIG. 2;

FIG. 5 is a diagram illustrating the force and bending path in a stepwise bending method according to the invention; and FIG. 6 is a fragmentary side view of a modified embodiment of a lifting hook subtending the rail head for engagement of the rail and incorporating an engagement force measuring device.

Figure 1:
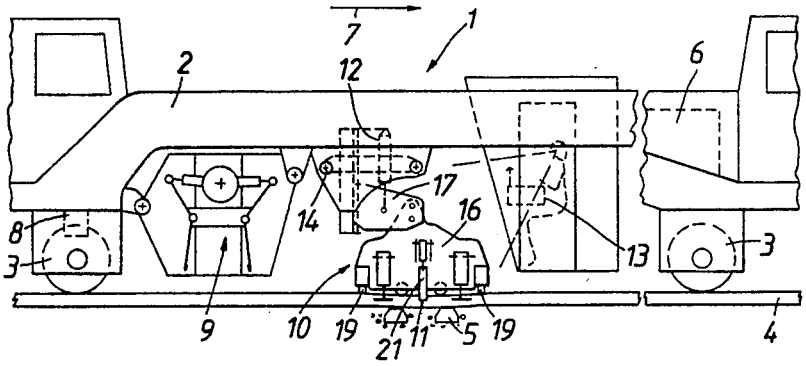

Referring now to the drawing and first to FIG. 1, wherein is shown mobile track working machine 1 embodied herein in a track leveling, lining and tamping machine. The track consists of two rails 4 fastened to ties 5, each rail having a rail head defining a running face and a vertical plane of symmetry and consisting of track rail sections having abutting ends forming rail joints 11. Machine 1 comprises elongated frame 2 mounted for mobility on the track on front and rear undercarriages 3, 3. Power plant 6 providing power for the various drives is mounted on machine frame 2 and drive 8 is designed to propel the machine in an operating direction along the track, indicated by arrow 7. Tamping head 9 is vertically and transversely adjustably mounted on the machine frame adjacent rear undercarriage 3 and comprises vibratory and reciprocable tamping tools for tamping ballast under respective ties. Mechanism 10 for bending the track rail section ends at rail joint 11 leads tamping head 9 in the operating direction. The bending mechanism is operated from control station 13 which is arranged in an operator's cab mounted on machine frame 2 in front of bending mechanism 10, in the operating direction, to enable an operator to monitor the bending operation visually. The entire bending mechanism is transversely movable along crossbeams 14 affixed to machine frame 2 between the two track rails for positioning above a respective rail.

Figure 2:
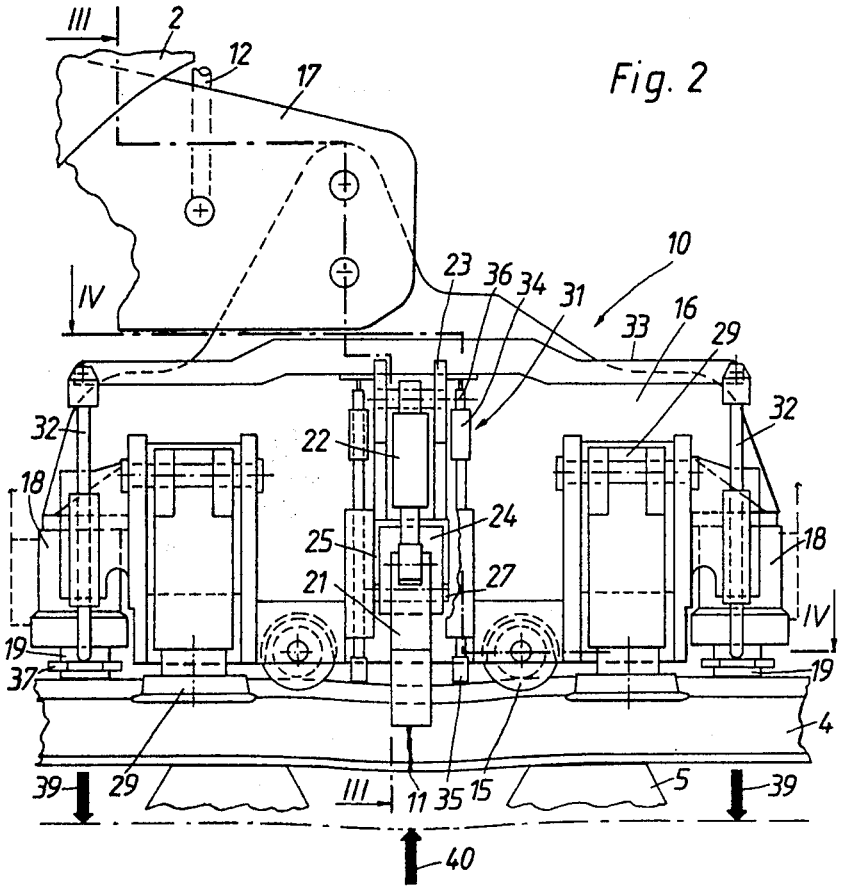
FIG. 2 is an enlarged, fragmentary side view showing the bending mechanism of FIG. 1.

As best shown in FIGS. 2 to 4, bending mechanism 10 comprises elongated carrier frame 16 which is vertically adjustably mounted on machine frame 2 above a respective track rail 4 by means of cantilevered bracket 17 which is transversely movable along crossbeams 14 with respect to the machine frame and which is vertically adjustable by cylinder-piston drive or jack 12. The carrier frame is supported on, and guided along, rail 4 by two double-flanged wheels 15, 15. The carrier frame has respective end regions spaced from each other in the direction of track rail 4 and a respective hydraulically operable and vertically adjustable thrust element is mounted in a respective end region of carrier frame 16 for engagement with the running face of the track rail. The illustrated thrust elements are each comprised of a cylinder 18 containing hydraulic pressure fluid for moving pressure ram 19 into engagement with the running surface of the rail. A rail lifting hook device is mounted centrally between the thrust elements on carrier frame 16 for engagement with track rail 4 and, according to the present invention, this rail lifting hook device includes two lifting hooks 21, 21 arranged symmetrically with respect to the vertical plane of symmetry of rail 4. Respective pivot 20 having an axis extending in the direction of rail 4 mounts a respective lifting hook 21 for pivoting into a rail engaging position wherein the lifting hook subtends the rail (see FIG. 3). One end of respective drive 22 is linked to each lifting hook at another pivot 28 for pivoting the hook linked thereto about pivot 20, the opposite end of each drive 22 being linked to a respective cantilevered arm 23 affixed to, and symmetrically laterally projecting from, carrier frame 16.

As can be seen best in FIG. 3, carrier frame 16 of bending mechanism 10 defines recess 25 and intermediate carrier 24 is transversely movable mounted on the carrier frame in the recess, and the intermediate carrier pivotally supports lifting hooks 21. This pendulum-like suspension of the two lifting hooks on an intermediate carrier which is substantially freely transversely movable enables the lifting hooks to be advantageously centered during each lifting stroke for automatically equalizing the loads for imparting equal stresses to the lifting hooks and thus to assure accurate bending of the rail ends in the vertical plane of symmetry of the rail. Therefore, minor transverse displacements of the center of the bending mechanism with respect to the rail, for example in track curves, or warped rails will not cause unbalanced excess loads on one or the other of the lifting hooks.

Intermediate carrier 24 has a concavely curved underside 26 supported on carrier frame 16 and support element 27 is arranged between the carrier frame and the concavely curved underside of the intermediate carrier which is symmetrical with respect to the vertical plane of symmetry of the rail and the pair of lifting hooks. Support element 27 is of a material which is worn down during use. This bearing provides a very cost-effective pendulum suspension of the lifting hooks which resists even the highest stresses while providing an automatic balancing of the load. The support element can be readily replaced when it has been worn down so that the carrier frame is protected against normal wear.

Pivot 20 for respective lifting hook 21, which is immediately adjacent the pivotal support of the intermediate carrier on the carrier frame, and other pivot 28 linking respective drive 22 to the lifting hook are spaced from each other in a direction extending transversely to track rail 4. Because the pivot for the lifting hook is immediately adjacent the carrier frame, any bending stress on the intermediate carrier, which disadvantageously affects the accuracy of the bending, is reduced to a minimum even when the bending stress is very high. The lateral spacing of the lifting hook pivot from the pivoting drive advantageously affects the leverage of the drive, thus increasing the clamping pressure of the hook against the rail and enhancing the hold the two lifting hooks have on the rail head.

To give a clearer and uncluttered view, FIG. 3 only shows one thrust element ram 19 in broken lines.

As best shown in FIG. 2 and schematically indicated in dash-dotted lines in FIG. 4, pairs of pivotal clamping rollers 29, 29 are arranged on carrier frame 16 between each thrust element and double-flanged wheel 15. The freely rotatable clamping rollers have flanges designed to subtend the rail head for clamping the rail therebetween. With this arrangement, the bending mechanism becomes a conventional track lifting and lining unit used for leveling and lining track, vertical adjustment drive 12 being used for leveling and lining drive 30 (see FIG. 4) being linked to the carrier frame for use in lining.

The bending operation is controlled by means of measuring device 31 which is designed to measure the lifting stroke determining the extent of the bending or the level of the track rail section end. The measuring device comprises four sensors 32 vertically adjustably guided on carrier frame 16 for sensing the level of the track rail section ends and measuring beam 33, as well as vertically adjustable transducers 34 at each side of lifting hooks 21 for generating electrical signals corresponding to the vertical adjustment of the transducers due to a lifting stroke effected by the hooks. Each transducer 34 has a rail sensing shoe 35 at a lower end thereof and an electric signal receiver 36 at an upper end of the transducer is arranged adjacent measuring beam 33. Respective pairs of sensors 32 are associated with a respective thrust element and have their upper ends linked to measuring beam 33 while their lower ends contact a base plate 37 connected to ram 19 of the thrust element, as best shown in FIG. 2.

The operation of the above-described apparatus will partly be evident from the description of its structure and will be explained hereinafter in connection with the method of this invention.

As soon as a rail joint 11, which may be welded, has been reached, machine 1 is moved until the pair of lifting hooks 21 has been exactly centered above the rail joint, and bending mechanism 10 is lowered for engagement with track rail 4 while the lifting hooks remain spread apart. The track rail is engaged by pivoting the pairs of clamping rollers 29 to subtend the rail head and is leveled and/or lined by operating drives 12 and/or 30 under the control of a leveling and lining reference system of the machine until the track rail has assumed the desired position. Subsequently, pivoting drives 22 are operated to pivot lifting hooks 21 until they subtend the rail head. If the lifting hooks are not in full clamping engagement with track rail 4, limit switches 38 (see FIG. 3) will serve as safety devices to prevent any subsequent actuation of pressure rams 19. If the lifting hooks are in their end position, i.e. in full clamping engagement, and limit switches 38 do not prevent actuation of the pressure rams, hydraulic pressure fluid will be automatically delivered through control station 13 to pressure rams 19 so that the pressure rams will engage the running face of track rail 4 and sensors 32 will be lowered into contact with base plate 37 to establish a measuring base, i.e. a zero base for the bending path. Any deviation from this measuring base at the track rail section ends is determined by vertically adjusting transducers 34 having rail sensing shoes 35 at the lower ends thereof in correspondence to the depression of rail joint 11. The resultant electrical signals from the displaceable sensors are transmitted to electrical signal receiver 36 at the upper ends of the transducers arranged adjacent measuring beam 33 to signal deviations from the measuring base and these signals are transmitted to the control station to control the subsequent stepwise bending operation by means of the integrated electronic control at station 13. This hydraulically operates pressure rams 19 to keep them in engagement with the running face of track rail 4 while lifting the track rail section ends stepwise with engaged lifting hooks 21 while continuously measuring the lifting stroke on the basis of the electrical signals received at the control station until the track rail section ends at rail joint 11 have been lifted to a selected excess level. The hydraulic operation of the pressure rams is interrupted between each lifting step and the lifting strokes in successive steps are automatically reduced as the selected excess level is approached in response to the electrical signals obtained when the hydraulic operation is interrupted.

The first bending step is initiated by operating pressure rams 19, which form a three-point bending system with lifting hooks 21, to produce downward pressure forces on track rail 4, which are illustrated by arrows 39 in FIG. 2. The lowering of pressure rams 19 causes carrier frame 16 and lifting hooks 21 mounted thereon to be raised, which produces an upwardly directed bending force indicated by arrow 40 to bend the track rail. The pressure on rams 19 is then relieved and the lifting stroke, which determines the extent of bending, is automatically ascertained by means of transducers 34 in control station 13. This establishes the new measuring base for the subsequent bending step. The work of the operator is limited to initiating the bending operation by depressing an actuating button for the control and to observing the entire operation. The bending operation is concluded when a predetermined tolerance value has been reached. After rail joint 11 has been lifted to this predetermined tolerance value, the machine is advanced until tamping head 9 is centered over the rail joint and the ballast under the rail joint is tamped to fix it in position.

In this operation, the bending is rapidly and accurately automatically controlled since the readily accessible rail head can be engaged and sensed without requiring any preparation while being securely clamped by the pair of lifting hooks during the entire bending process. This is of particular importance when the pressure on the thrust elements 19 is relieved between the successive bending steps since the rail remains securely clamped and the rail joint cannot deviate to one side of the other because of its own tension.

FIG. 5 diagrammatically illustrates the stepwise bending operation, coordinate 46 indicating the force and coordinate 47 indicating the bending path. The entire bending path to reach tolerance value 51 is indicated by 48, the difference between 48 and 49 showing the bending path of the first bending step. The differences between 49 and 50, and between 50 and 51, correspond, respectively, to the second and third bending steps. As the path of the force line clearly shows, the elasticity of the bending requires a displacement of the rail joint above the actual bending value at each bending step to obtain a plastic deformation.

As FIG. 6 schematically illustrates, it is possible to measure not only the bending path but also the bending force during the bending operation, for example by mounting displaceable abutment 43 on base plate 41 of lifting hook 42 and providing pressure gage 44, which may be a piezo-electrical element, between the displaceable abutment 43 and the base plate 41. This makes it possible, for example, to determine the required bending force automatically in a computer receiving an input parameter corresponding to the cross section of rail 45 to be bent and another input parameter corresponding to the required bending path to obtain an output controlling the bending in a single step.

What is claimed is:

1. In a mobile track working machine for a track consisting of two rails fastened to ties, each rail having a rail head defining a running face and a vertical plane of symmetry and consisting of track rail sections having abutting ends forming rail joints, the track working machine comprising a frame mounted for mobility on the track: a mechanism for bending the track rail section ends, the bending mechanism comprising (a) a carrier frame vertically adjustably mounted on the machine frame above a respective one of the track rails, the carrier frame defining a recess and having respective end regions spaced from each other in the direction of the one track rail, (b) a respective hydraulically operable and vertically adjustable thrust element mounted in a respective one of the end regions of the carrier frame for engagement with the running face of the one track rail, (c) an intermediate carrier transversely movably mounted on the carrier frame in said recess, and (d) a rail lifting hook device mounted centrally between the thrust elements on the carrier frame for engagement with the one track rail, the hook device being operable to bend the track rail section ends upon engagement of the thrust elements with the track rail running face and including (1) two lifting hooks pivotally supported on the intermediate carrier and arranged symmetrically with respect to the vertical plane of symmetry of the one rail, (2) a respective pivot having an axis extending in the direction of the one track rail and mounting a respective one of the lifting hooks for pivoting into a rail engaging position wherein the lifting hook subtends the rail head, and (3) a respective independent drive linked to each lifting hook at another pivot for pivoting the hook linked thereto.

2. In the track working machine of claim 1, the intermediate carrier being symmetrical with respect to the vertical plane of symmetry.

3. In the track working machine of claim 1, wherein the pivot for the respective lifting hook and the other pivot linking the respective drive to the lifting hook are spaced from each other in a direction extending transversely to the one track rail.

4. In a mobile track working machine for a track consisting of two rails fastened to ties, each rail having a rail head defining a running face and a vertical plane of symmetry and consisting of track rail sections having abutting ends forming rail joints, the track working machine comprising a frame mounted for mobility on the track: a mechanism for bending the track rail section ends, the bending mechanism comprising (a) a carrier frame defining a recess and being vertically adjustably mounted on the machine frame above a respective one of the track rails and having respective end regions spaced from each other in the direction of the one track rail, (b) a respective hydraulically operable and vertically adjustable thrust element mounted in a respective one of the end regions of the carrier frame for engagement with the running face of the one track rail, (c) a rail lifting hook device mounted centrally between the thrust elements on the carrier frame for engagement with the one track rail, the hook device being operable to bend the track rail section ends upon engagement of the thrust elements with the track rail running face and including (1) two lifting hooks arranged symmetrically with respect to the vertical plane of symmetry of the one rail, (2) a respective pivot having an axis extending in the direction of the one track rail and mounting a respective one of the lifting hooks for pivoting into a rail engaging position wherein the lifting hook subtends the rail head, and (3) a respective independent drive linked to each lifting hook at another pivot for pivoting the hook linked thereto, (d) an intermediate carrier transversely movably mounted on the carrier frame in said recess, (1) the intermediate carrier pivotally supporting the lifting hooks and having a concavely curved underside supported on the carrier frame, and (e) a support element arranged between the carrier frame and the concavely curved underside of the intermediate carrier, the support element being of a material which is worn down during use.

* * * * *